US008001821B2

(12) United States Patent
Kondo et al.

(10) Patent No.: US 8,001,821 B2
(45) Date of Patent: Aug. 23, 2011

(54) THERMOFORMING PRESS

(75) Inventors: Kiyohito Kondo, Paderborn (DE); Martin Pohl, Altenbeken (DE); Robert Stockter, Hannover (DE)

(73) Assignees: Benteler Automobiltechnik GmbH, Paderborn (DE); Aisin Takaoka Co. Ltd., Aichi (JP)

( * ) Notice: Subject to any disclaimer, the term of this patent is extended or adjusted under 35 U.S.C. 154(b) by 441 days.

(21) Appl. No.: 12/273,914

(22) Filed: Nov. 19, 2008

(65) Prior Publication Data

US 2009/0126447 A1 May 21, 2009

(30) Foreign Application Priority Data

Nov. 21, 2007 (DE) ..... 10 2007 056 186

(51) Int. Cl.
*B21D 37/16* (2006.01)

(52) U.S. Cl. ..... 72/342.2

(58) Field of Classification Search ..... 72/342.1, 72/342.2, 342.3, 342.7, 342.94, 347, 364; 148/369, 644, 647, 660, 664
See application file for complete search history.

(56) References Cited

U.S. PATENT DOCUMENTS

| | | | | |
|---|---|---|---|---|
| 3,733,161 | A | 5/1973 | Nussbaum | |
| 4,166,521 | A * | 9/1979 | Okunishi et al. | 148/325 |

FOREIGN PATENT DOCUMENTS

| | | |
|---|---|---|
| DE | 24 52 486 | 5/1975 |
| DE | 26 03 618 | 12/1976 |
| DE | 102004045155 | 3/2006 |
| DE | 102005028010 | 7/2006 |
| DE | 102005042765 | 3/2007 |

* cited by examiner

*Primary Examiner* — Teresa M Ekiert
(74) *Attorney, Agent, or Firm* — Henry M. Feiereisen; Ursula B. Day

(57) ABSTRACT

A thermoforming press for forming and hardening metal sheets includes an upper die and a lower die. At least one of the upper and lower dies has a mold jaw and a support jaw which are movable relative to one another between a first position in which the support jaw rests against the mold jaw to block a flow of coolant between the mold jaw and the support jaw, and a second position in which the support jaw is spaced from the mold jaw by a distance to define a cooling gap for coolant to flow between the mold jaw and the support jaw.

10 Claims, 2 Drawing Sheets

THERMOFORMING PRESS

CROSS-REFERENCES TO RELATED APPLICATIONS

This application claims the priority of German Patent Application, Serial No. 10 2007 056 186.7, filed Nov. 21, 2007, pursuant to 35 U.S.C. 119(a)-(d), the content of which is incorporated herein by reference in its entirety as if fully set forth herein.

BACKGROUND OF THE INVENTION

The present invention relates to a thermoforming press.

Nothing in the following discussion of the state of the art is to be construed as an admission of prior art.

German Offenlegungsschrift DE 24 52 486 C2 describes a process to make a hardened steel article by heating a hardenable steel blank to hardening temperature and then placing it in a press tool in which the blank is deformed and simultaneously rapidly cooled to obtain a martensitic and/or bainitic structure, while the blank remains in the press tool. Cooling is implemented indirectly via cooling channels for circulation of a coolant. Provision of such cooling channels is difficult to realize and costly.

German Offenlegungsschrift DE 26 03 618 describes a thermoforming press with upper and lower dies having incorporated therein concentric annular grooves which are fluidly connected to channels extending through the dies. As a result, coolant flows through these channels into the annular grooves for direct contact with a steel article to be hardened. This type of press is also complex and requires long process times and extensive maintenance.

It would be desirable and advantageous to provide an improved thermoforming press to obviate prior art shortcomings.

SUMMARY OF THE INVENTION

According to one aspect of the present invention, a thermoforming press for forming and hardening metal sheets includes an upper die and a lower die, wherein at least one of the upper and lower dies has a mold jaw and a support jaw which are movable relative to one another between a first position in which the support jaw rests against the mold jaw to block a flow of coolant between the mold jaw and the support jaw, and a second position in which the support jaw is spaced from the mold jaw by a distance to define a cooling gap for coolant to flow between the mold jaw and the support jaw.

The present invention resolves prior art problems by configuring at least one of the upper and lower dies of the thermoforming press of two parts, i.e. a mold jaw and a support jaw. As a result, the thermoforming press is provided with a cooling system in which the distance between the coolant guidance and the tool surface or forming surface in the mold jaw can be minimized. Cooling is thus continuously ensured during the forming process so that the retention time of the pressed parts in the thermoforming press is kept to a minimum, attaining maximum efficiency.

Prior to the forming process, the mold jaw and the support jaw assume the cooling (second) position so that coolant is able to flow into the cooling gap. As a result, the mold jaw and in particular its mold geometry is cooled. The actual forming process takes place, when the cooling gap is closed, i.a. the mold jaw and the support jaw have moved to the blocking (first) position in which the support jaw rests against the mold jaw. In other words, in this blocking position, the mold jaw and the support jaw virtually form a unitary structure. As a result, the press remains stable during the forming process while exposed to high compression forces.

The thermoforming press is then closed to shape the metal sheet between the upper and lower dies to the desired sheet metal article. The metal sheet is shaped into the sheet metal article, when the thermoforming press is fully closed. The locking force of the thermoforming press is then applied only to maintain the contact between the shaped sheet metal article and the upper and lower dies and to thereby establish a heat transfer during the cooling and hardening step. In this state, the cooling gap between the mold jaw and the support jaw is opened again so that coolant is able to flow through the cooling gap across the entire surface and at short distance to the warm article. Cooling is thus optimized. The presence of the cooling gap is maintained until the thermoforming press is closed again.

In general, it is also conceivable to leave the mold jaw and the support jaw in the blocking position during the hardening process because the heat transfer via the closed upper and lower dies is sufficient to carry out hardening. When the thermoforming press is then opened, the cooling gap is also opened to cool down the upper and lower dies.

According to another advantageous feature of the present invention, the support jaw may rest in the blocking (first) position against the mold jaw in a form-fitting manner. The contacting surfaces of support jaw and mold jaw have complementary contour to correspond to one another.

According to another advantageous feature of the present invention, the cooling gap may extend in the cooling (second) position on a backside of the mold jaw in confronting relationship to the support jaw across a mold geometry of the mold jaw.

According to another advantageous feature of the present invention, a linear drive assembly may be provided for moving the mold jaw and the support jaw relative to one another.

According to another advantageous feature of the present invention, the linear drive assembly may be constructed in the form of a piston and cylinder unit interposed between the mold jaw and the support jaw. Especially suitable is the presence of hydraulic cylinders. Of course, other configurations of a linear drive assembly may be conceivable as well.

According to another advantageous feature of the present invention, the mold jaw may have a coolant port in fluid communication with the cooling gap to allow supply and discharge of coolant.

According to another advantageous feature of the present invention, at least one seal is provided for sealing the mold jaw and the support jaw against one another. In this way, coolant is prevented from escaping via the movement and guiding surfaces between the mold jaw and the support jaw. The seal may suitably be placed in the opposing guide surfaces of the mold jaw and/or support jaw. Suitably, the seal is received in a groove in the support jaw above and below the coolant port, respectively.

According to another advantageous feature of the present invention, the mold jaw may be made of a thin steel shell having a geometry in correspondence to the article being produced. The support jaw is shaped accordingly. The mold jaw may have a wall thickness of 4-15 mm. Currently preferred is a wall thickness of 5-10 mm. A comparably thin wall thickness of the mold jaw results in a good heat exchange between coolant and the hot-formed article.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
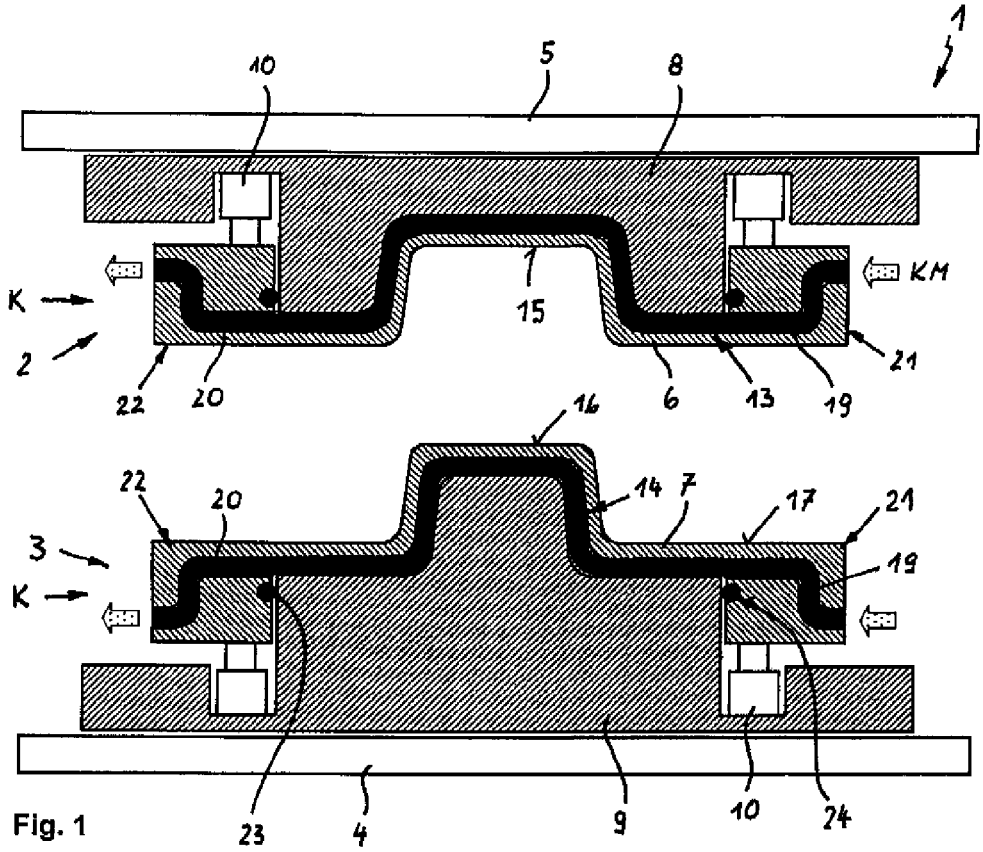
FIG. 1 is a schematic vertical section of a thermoforming press according to the present invention in open position and with open cooling channel.

Throughout all the figures, same or corresponding elements may generally be indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there is shown a schematic vertical section of a thermoforming press according to the present invention, generally designated by reference numeral 1. The thermoforming press 1 essentially includes an upper die 2 and a lower die 3. The lower die 3 is arranged on a press base 2 whereas the upper die 2 is mounted to a press carriage 5 which can be moved in the thermoforming press 1 in a vertical direction in relation to the press base 4 and the lower die 3.

The upper die 2 has a mold jaw 6 and a support jaw 8 which can move relative to one another with the assistance of linear drives 10 in the form of piston and cylinder units, in particular hydraulic cylinders, between the mold jaw 6 and the support jaw 8. Likewise the lower die 3 has a mold jaw 7 and a support jaw 9 which can move relative to one another with the assistance of linear drives 10 in the form of piston and cylinder units, in particular hydraulic cylinders, between the mold jaw 7 and the support jaw 9.

Figure 2:
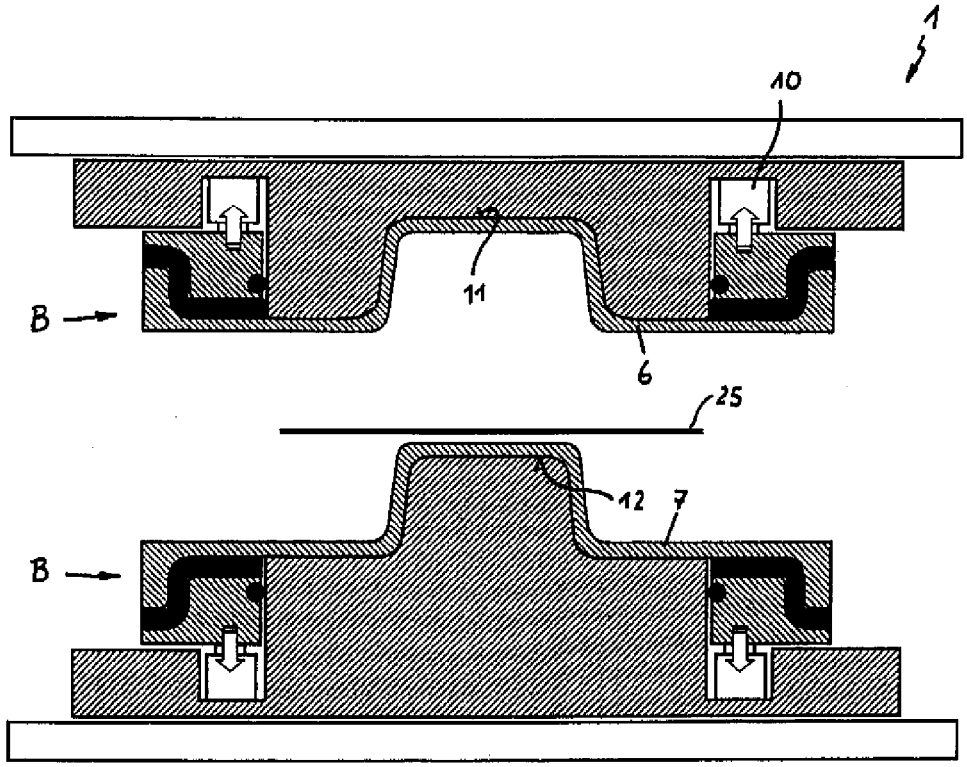
FIG. 2 is a schematic vertical section of the thermoforming press, still in open position but with closed cooling channel.
Figure 3:
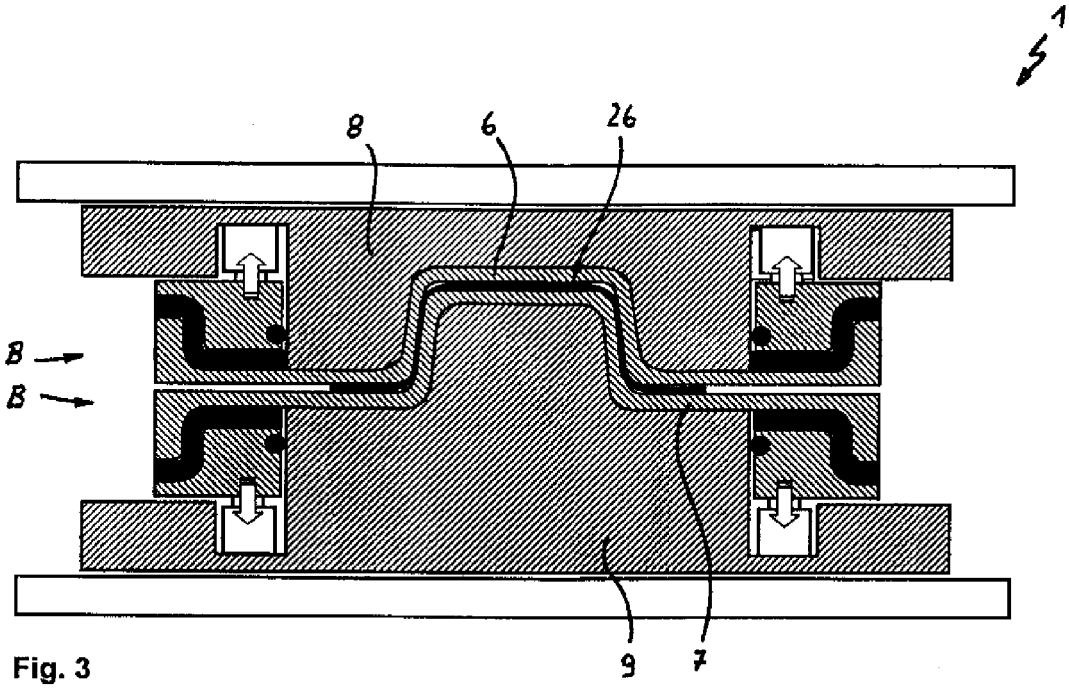
FIG. 3 is a schematic vertical section of the thermoforming press in closed position during a forming process.

FIG. 1 shows a position of the thermoforming press 1 in which the upper and lower dies 2, 3 are moved apart to assume an open position. In the open position of the thermoforming press 1 in FIG. 1, the mold jaw 6 and the support jaw 8 of the upper die 2 and the mold jaw 7 and the support jaw 9 of the lower die 3 are moved relative to one to respectively assume a cooling position K in which coolant KM is able to flow through a cooling gap 13 defined between the mold jaw 6 and the support jaw 8 and through a cooling gap 14 defined between the mold jaw 7 and the support jaw 9. In FIG. 2, the upper and lower dies 2, 3 still assume the open position, however the mold jaw 6 and the support jaw 8 and the mold jaw 7 and the support jaw 9 are moved relative to one to assume a blocking position B in which a coolant flow through the cooling gaps 13, 14, respectively, is cut. In the blocking position B, the support jaw 8 rests form-fittingly upon the backside 11 of the mold jaw 6 in confronting relationship to the support jaw 8. Likewise, the support jaw 9 of the lower die 3 rests form-fittingly upon the support-jaw-confronting backside 12 of the mold jaw 7 of the lower die 3. As a result, the support jaw 8 and the mold jaw 6 of the upper die 2 and the support jaw 9 and the mold jaw 7 of the lower die 3, form each in the blocking position B a solid unitary structure. FIG. 3 shows the upper and lower dies 2, 3 in closed position, with the mold jaws 6, 7 and the support jaws 8, 9 still respectively assuming the blocking position B.

In the cooling position K, the mold jaw 6 and the support jaw 8 are arranged at a distance "a" to one another so as to define the cooling gap 13 between the mold jaw 6 and the support jaw 8 of the upper die 2. Likewise, the mold jaw 7 and the support jaw 9 are arranged at a distance "a" to one another so as to define the cooling gap 14.

The mold jaws 6 and 7 have mold geometries 15 and 16, respectively, which correspond to one another and conform to the contour of the metal sheet. In the non-limiting example shown here, the mold geometry 16 of the mold jaw 7 of the lower die 3 forms a dome-shaped male die which projects out from the base surface 17 of the mold jaw 7 and plunges during the forming process into the complementary mold geometry 15 forming a female die which is inwardly recessed with respect to the base surface 18 of the mold jaw 6.

The mold jaw 6 and the mold jaw 7 are each made of a thin steel shell whose respective mold geometries 15 and 16 conform to the contour of the article being made. The mold jaws 6, 7 have each in the area of their mold geometries 15, 16 a constant wall thickness "s" of 4-15 mm. Currently preferred is a wall thickness "s" of 5-10 mm.

Supply and drainage of coolant KM to and from the cooling gap 13 and cooling gap 14 is realized via coolant ports 19, 20 in side members 21, 22 which are configured wider than the pertaining mold jaws 6, 7. In the cooling position K, the cooling ports 19, 20 are fluidly connected with the cooling gaps 13 and 14, respectively, to allow flow of coolant KM through the cooling gaps 13 and 14.

Reference numeral 23 designates seals to seal the mold jaws 6, 7 and the support jaws 8, 9 against one another. Each seal 23 is received in a groove 24 formed in the mold jaw 6 and the mold jaw 7. The grooves 24 are located In the upper die 2 above the coolant ports 19, 20 and in the lower die 3 below the coolant ports 19, 20.

The mode of operation of the thermoforming press 1 will now be described.

Prior to the forming operation of a metal sheet 25, the thermoforming press 1 is opened and the upper and lower dies 2, 3 are moved apart and assume the cooling position K. This situation is shown in FIG. 1. The cooling gap 13 in the upper die 2 and the cooling gap 14 in the lower die 3 are thus open to allow a flow of coolant KM there through. The cooling gaps 13, 14 extend respectively on the backsides 11, 12 of the mold jaws 6, 7 in confronting relationship to the support jaws 8, 9 across the surface of the mold geometries 15, 16 of the mold jaws 6, 7 at a slight distance "a" which corresponds to the wall thickness "s" of the mold jaws 6, 7 in the area of their mold geometries (FIG. 1).

Next, the cooling gaps 13, 14 are closed to shape the metal sheet 25. The mold jaws 6, 7 and the support jaws 8, 9 of the upper and lower dies 2, 3 are hereby moved into the blocking position B by the linear drives 10 in a direction indicated by the arrows in FIG. 2 to eliminate the cooling gaps 13, 14, respectively, and thereby cut a coolant flow. The metal sheet 25 is placed into the thermoforming press 1 and heated to a hardening temperature.

Next, the thermoforming press 1 is closed and the metal sheet 25 is shaped to a sheet metal article 26, as shown in FIG. 3. The thermoforming press 1 is closed by a downward movement of the press carriage 5 together with the upper die 2. As the thermoforming press 1 closes, the metal sheet 25 tracks the mold geometries 15, 16 and is thereby transformed into the sheet metal article 26.

Figure 4:
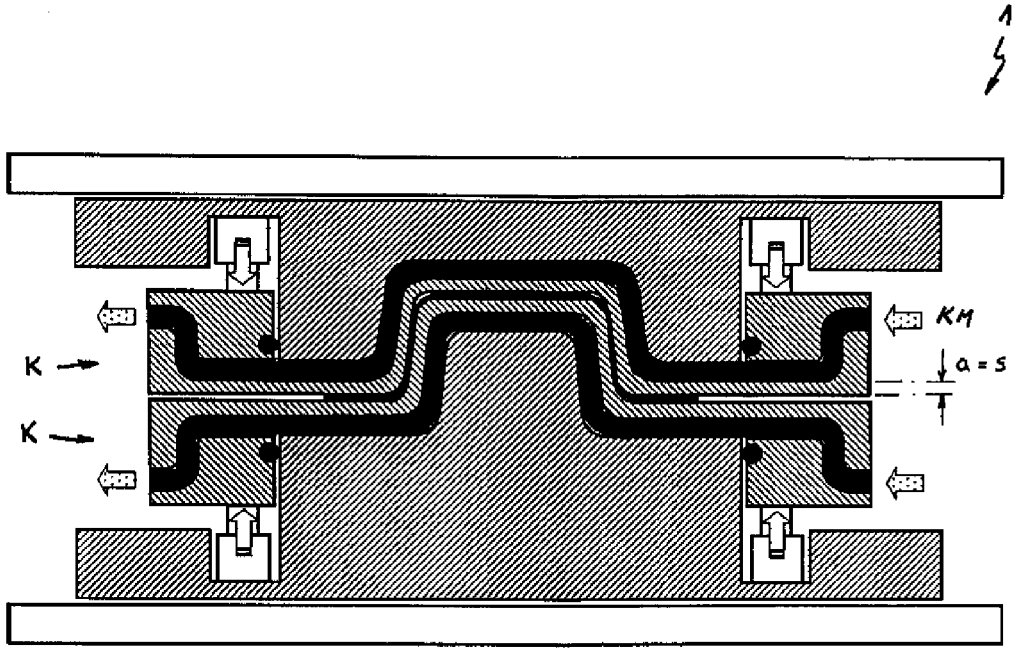
FIG. 4 is a schematic vertical section of the thermoforming press still in closed position but with open cooling channel.

Once the thermoforming press 1 is fully closed, the actual forming process of the metal sheet 25 is concluded. The locking force of the thermoforming press 1 is now used only for maintaining the contact between the sheet metal article 26 and the upper and lower dies 2, 3. The cooling gaps 13, 14 are now opened again in this phase, as shown in FIG. 4. In other words, the mold jaws 6, 7 and the support jaws 8, 9 of the upper and lower dies 2, 3 are moved into the cooling position K by the linear drives 10 in a direction indicated by the arrows in FIG. 4 to re-establish a flow communication through the cooling gaps 13, 14. Coolant KM thus is able to flow across the entire surface in the cooling channels formed by the cooling gaps 13, 14 and at a short distance "a" to the hot formed article 26. In view of the short distance "a" between the article 26 and the coolant KM and in view of the introduction of coolant across the entire surface, significant heat is carried off from the article 26, thereby realizing an efficient cooling and hardening process.

When the article has hardened, the thermoforming press 1 is opened again, while the cooling gaps 13, 14 remain open. In this way, the mold jaws 6, 7 can be further cooled down. The finished and hardened article 26 can be removed from the thermoforming press 1 and a new cycle may begin.

While the invention has been illustrated and described in connection with currently preferred embodiments shown and described in detail, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

What is claimed is:

1. A thermoforming press for forming and hardening a metal sheet, said thermoforming press comprising an upper die and a lower die, wherein at least one of the upper and lower dies has a mold jaw and a support jaw which are movable relative to one another between a first position in which the support jaw rests against the mold jaw to block a flow of coolant between the mold jaw and the support jaw, and a second position in which the support jaw is spaced from the mold jaw by a distance to define a cooling gap for coolant to flow between the mold jaw and the support jaw.

2. The thermoforming press of claim 1, wherein the support jaw rests in the first position against the mold jaw in a form-fitting manner.

3. The thermoforming press of claim 1, wherein the cooling gap extends on a backside of the mold jaw in confronting relationship to the support jaw across a mold geometry of the mold jaw.

4. The thermoforming press of claim 1, further comprising a linear drive assembly for moving the mold jaw and the support jaw relative to one another.

5. The thermoforming press of claim 4, wherein the linear drive assembly is constructed in the form of a piston and cylinder unit interposed between the mold jaw and the support jaw.

6. The thermoforming press of claim 1, wherein the mold jaw has coolant ports in fluid communication with the cooling gap, when the mold jaw and support jaw assume the second position.

7. The thermoforming press of claim 1, further comprising at least one seal for sealing the mold jaw and the support jaw against one another.

8. The thermoforming press of claim 1, wherein the mold jaw has a wall thickness of 4-15 mm.

9. The thermoforming press of claim 1, wherein the mold jaw has a wall thickness of 5-10 mm.

10. The thermoforming press of claim 1, wherein the mold jaw has a wall thickness sized to correspond to the distance between the mold jaw and the cooling jaw.

* * * * *